US007377471B1

(12) United States Patent
Compton et al.

(10) Patent No.: US 7,377,471 B1
(45) Date of Patent: May 27, 2008

(54) METHOD AND SYSTEM FOR OPENING AND SECURING A RAILROAD FROG

(76) Inventors: Harry L. Compton, 7840 Ave. N., Kearney, NE (US) 68847; Jeffery E. Cole, 1204 "R"Rd., Minden, NE (US) 68959

( * ) Notice: Subject to any disclaimer, the term of this patent is extended or adjusted under 35 U.S.C. 154(b) by 357 days.

(21) Appl. No.: 11/145,690

(22) Filed: Jun. 6, 2005

(51) Int. Cl.
*E01B 7/00* (2006.01)

(52) U.S. Cl. ..... 246/391; 246/276; 246/389; 246/382; 246/468; 246/472

(58) Field of Classification Search ..... 246/391, 246/382, 385, 386, 389, 390, 468, 472, 276; 403/43, 44, 45
See application file for complete search history.

(56) References Cited

U.S. PATENT DOCUMENTS 4,052,027 A * 10/1977 Taylor ..... 410/66

* cited by examiner

*Primary Examiner*—Mark T. Le

(57) ABSTRACT

A method and system are provided for opening and securing a railroad frog. The system is provided with a body member and a plurality of attachment members, which are selectively securable with the body member. The attachment members are structurally configured to secure to different structural features along spring wing rails and fixed structures positioned opposite the spring wing rail. Manual actuation of a tensioning mechanism that is coupled with the body member advances opposing first and second attachment members toward one another, moving the spring wing rail into an open position. Wedge members, coated in a non-slip material are provided as an additional means for securing the spring wing rail in an open position.

18 Claims, 5 Drawing Sheets

METHOD AND SYSTEM FOR OPENING AND SECURING A RAILROAD FROG

BACKGROUND OF THE INVENTION

1. Field of the Invention

The present invention relates to maintenance equipment used on railroads and more particularly to a device for manually opening and securing a railroad frog.

2. Description of the Related Art

Railroad frogs are installed at the intersections of two running rails to permit the flanges of railroad car wheels to pass from one of the rails to the next. The frog supports the car wheels as they pass over the missing rail tread surface between the throat and the fixed point of the frog, providing flangeways through which the flanges of the car wheels are allowed to pass. A standard railroad frog typically includes a frog fixed point or "v-point" that is supported by a base plate. A laterally movable spring wing rail is positioned on the base plate along one side of the v-point. A fixed wing rail is also secured to the base plate, on the opposite side of the v-point. A plurality of holddown subassemblies are coupled with the spring wing rail and the base plate, allowing lateral movement of the spring wing rail while prohibiting vertical movement. One or more supplementary compression spring closer elements, such as springs or shock assemblies are, coupled with the spring wing rail and urge the spring wing rail into a closed position. The spring wing rail is forced into an open position by the wheels of a car passing through the frog.

Railroad frogs are not provided with mechanisms that selectively open and secure the spring wing rail. This is problematic in a number of different situations. First, railroad frogs require periodic maintenance and cleaning. In order to properly clean or maintain the frog an individual must be able to selectively open and close the spring wing rail. Railroad frogs also pose a potentially hazardous situation to smaller, lightweight rail cars when they attempt to pass through the frogs. Various types of maintenance equipment, such as ballast regulators, handcars, spikers, track cars, rail grinders, and the like are oftentimes too light to force the spring wing rail into an open position when they attempt to pass through the frog. Accordingly, when such cars approach the frog at a slow rate of speed, they are stopped, preventing its passage through the frog. However, when such cars approach the frog at a higher rate of speed, the car is frequently tipped or derailed, causing serious injuries to its occupants and damage to the car and the rails.

The prior art is nearly devoid of systems or methods for securing railroad frogs in an open position for any purpose. The typical method of opening a spring wing rail of a frog is to provide one individual with an elongated lining bar or jack and a second individual with a plurality of wedges, typically made of wood. The first individual inserts one end of the lining bar or jack between the spring wing rail and the v-point and slowly pries the spring wing rail into an open position. The second individual then places the wedges in the gap formed between the spring wing rail and the v-point. However this method is difficult and quite dangerous. The risk of injury to either individual is substantial. Moreover, the wooden wedges frequently fail and are rarely reusable.

Accordingly, what is needed is a system and method for opening and securing railroad frogs that may be safely and efficiently implemented by a single person.

SUMMARY OF THE INVENTION

The present invention provides a device for opening a railroad frog, where the railroad frog is provided with a frog fixed point, a laterally movable spring wing rail and a fixed wing rail. The device is generally comprised of a body member having first and second end portions. A first attachment member is operatively coupled with a first end portion of the body member and is shaped to releasably engage a portion of the spring wing rail. A second attachment member is operatively coupled with the second end portion of the body member and is shaped to releasably engage an anchoring member that is secured in a fixed position, spaced-apart from the spring wing rail. A tensioning mechanism is operatively coupled with the body member for selectively moving the first and second attachment members toward one another. Where the first attachment member is coupled to a portion of the spring wing rail and the second attachment member is coupled with the anchoring member, advancement of the first and second attachment members toward one another moves the spring wing rail into an open position.

The first attachment member is provided in different embodiments, enabling the device to be coupled with various structures that may be found along the spring wing rail, such as threaded bolts, shock mounts, and other common structural features. Likewise, the second attachment member is provided in various different structural embodiments that enable it to be coupled with various anchoring members, such as rails that are positioned opposite the spring wing rail, shock mounting brackets, and the like. The versatility of the various attachment member embodiments permit them to be interchanged with one another and incorporated in different pairings to fit virtually any railroad frog configuration encountered in the field.

The tensioning means is provided in various embodiments to enable a user to manually engage the device and draw the first and second attachment members toward one another. In one preferred embodiment, a lever manually actuates a pawl that incrementally advances along a ratchet assembly that is coupled with the body member. Actuation of the tensioning means rotates the body member, which is threadably coupled with at least one of the first and second attachment members, advancing the attachment members toward one another.

A plurality of wedge members are provided that may be disposed between a spring wing rail and the frog v-point once the spring wing rail is moved into an open position. A friction-enhancing material is disposed along the exterior surface of the wedge members to resist unintentional slipping between the wedge members and the rails. The wedge members provide additional security for ensuring that the spring wing rail is secured in an open position.

It is therefore a principle object of the present invention to provide a method and system for opening and securing a railroad frog.

A further object of the present invention is to provide a method for manually opening a railroad frog, using a device that may be operated by a single person.

Still another object of the present invention is to provide a device for opening and securing a railroad frog that is provided with a plurality of different attachments, enabling the device to be used with various railroad frogs having different structural features.

Yet another object of the present invention is to provide a device for manually opening and securing a railroad frog that is sufficiently compact and lightweight so that the device may be easily and conveniently transported and used by a single individual.

A further object of the present invention is to provide a method and system for opening and securing a railroad frog that requires no structural alteration of the railroad frog or the adjacent rail components.

Still another object of the present invention is to provide a device for safely opening and securing a railroad frog in a manner that permits the frog to be serviced and/or cleaned without first removing the device from the frog.

These and other objects of the present invention will be apparent to those having skill in the art.

DETAILED DESCRIPTION OF THE INVENTION

In the following detailed description of exemplary embodiments, reference is made to accompanying FIGS. 1-6, which form a part hereof and show, by way of illustration, exemplary embodiments of the present invention. These embodiments are disclosed in sufficient detail to enable those skilled in the art to practice the invention. It is to be understood that other embodiments may be utilized, however, and other changes may be made without departing from the spirit or scope of the present invention. The following detailed description is, therefore, not to be taken in a limiting sense in that the scope of the present invention is defined only by the appended claims.

Figure 4:
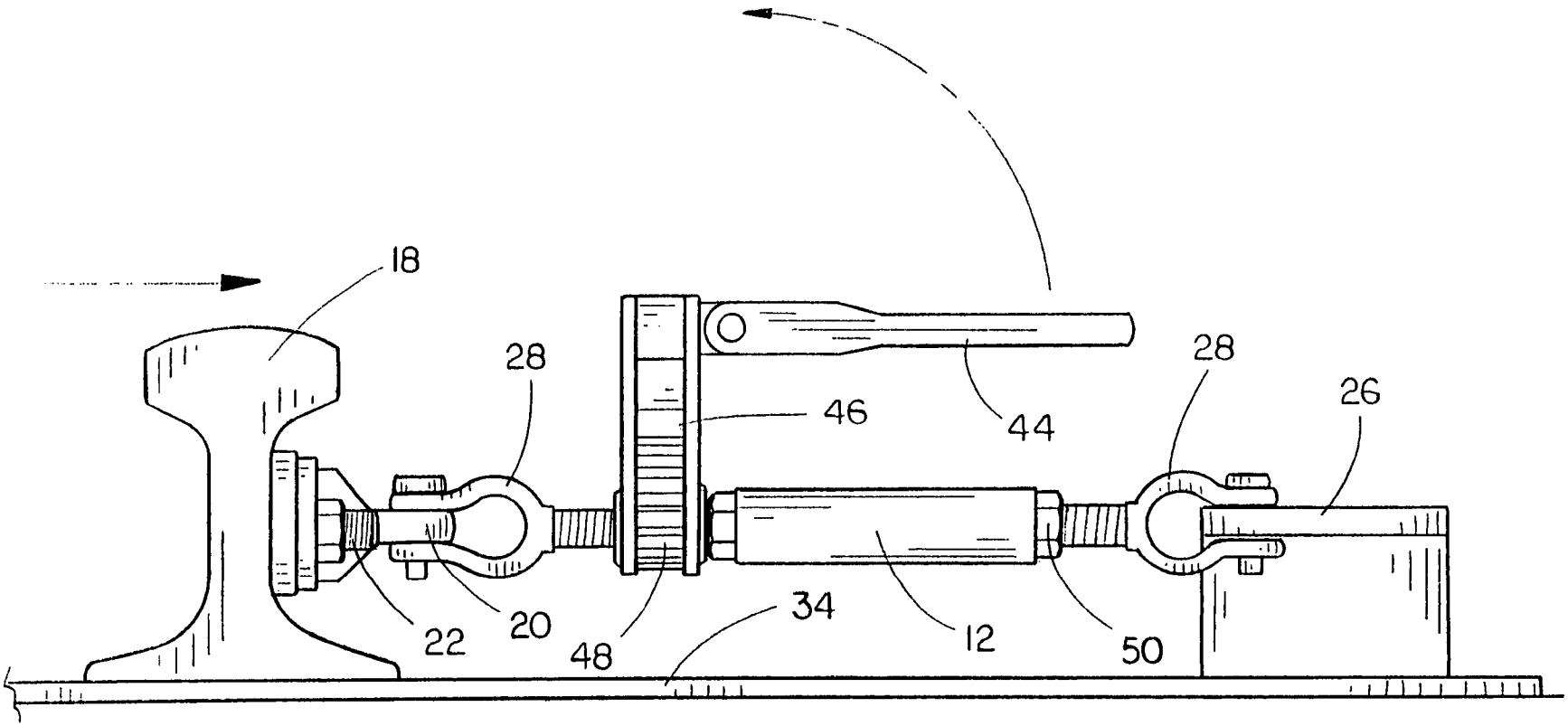
FIG. 4 is a side elevation view of the railroad frog opening and securing device depicted in FIG. 3.

The system 10 for use in opening and securing a railroad frog is generally provided with a body member 12, having a first end portion 14 and a second end portion 16. In one preferred embodiment, the body member 12 is provided in the form of a generally rigid, elongated bar. However, several other structures may be substituted for the elongated bar without departing from the scope of the present invention. Some of these other structures are discussed in greater detail herein below. A first attachment member is coupled with the first end portion 14 of the body member 12. Likewise, a second attachment member is coupled with the second end portion 16 of the body member 12. Numerous different structural configurations are contemplated for use as the first and second attachment members. It will be important, however, that the first attachment member be shaped to releasably engage at least a portion of the frog spring wing rail 18, such as a shock mount 20, a threaded end portion of a bolt 22 that extends outwardly from the spring wing rail 18, or another structural feature of the spring wing rail 18. For example, where a frog was originally configured to have a shock 24 extending between a shock mount 20 and a shock bracket 26, the first attachment member could be releasably coupled with an opening formed within the shock mount 20. A shackle 28 or other similar structural member such as an open link, D-ring, or the like, will be well suited for engagement at one end with the shock mount 20 and at its opposite end to the body member 12. An example of this arrangement is depicted in FIG. 4, wherein the pin of the shackle 28 is disposed through the shackle and is threadably secured thereto to prevent the unintentional release of the shackle 28 from the frog.

Figure 5:
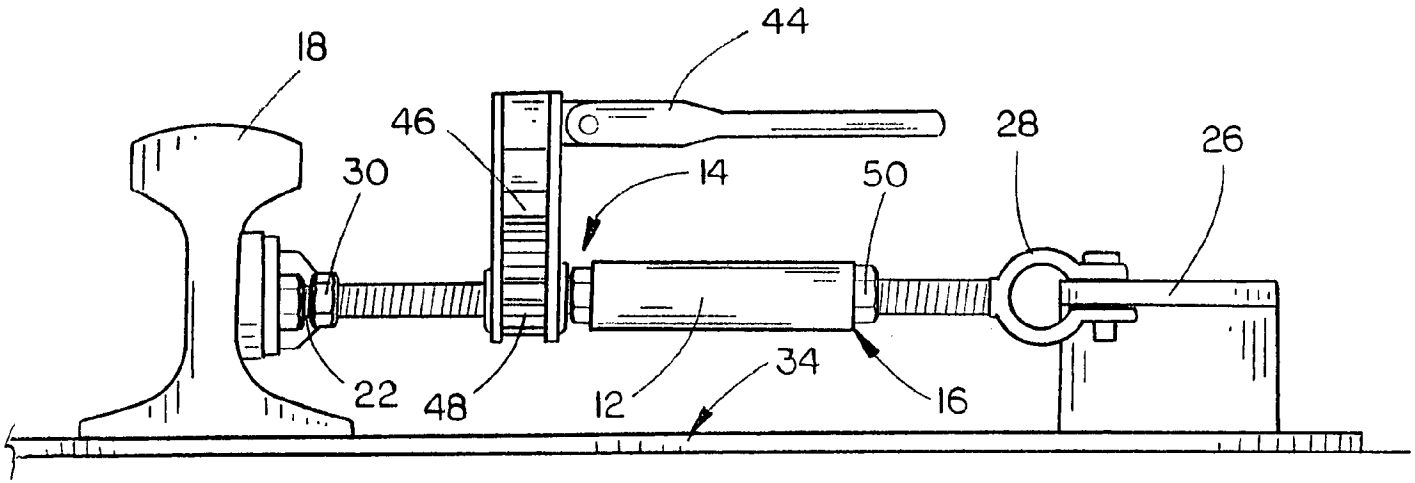
FIG. 5 is a side elevation view of another embodiment of the railroad frog opening and securing device of the present invention as it could be coupled with a railroad frog.
Figure 6:
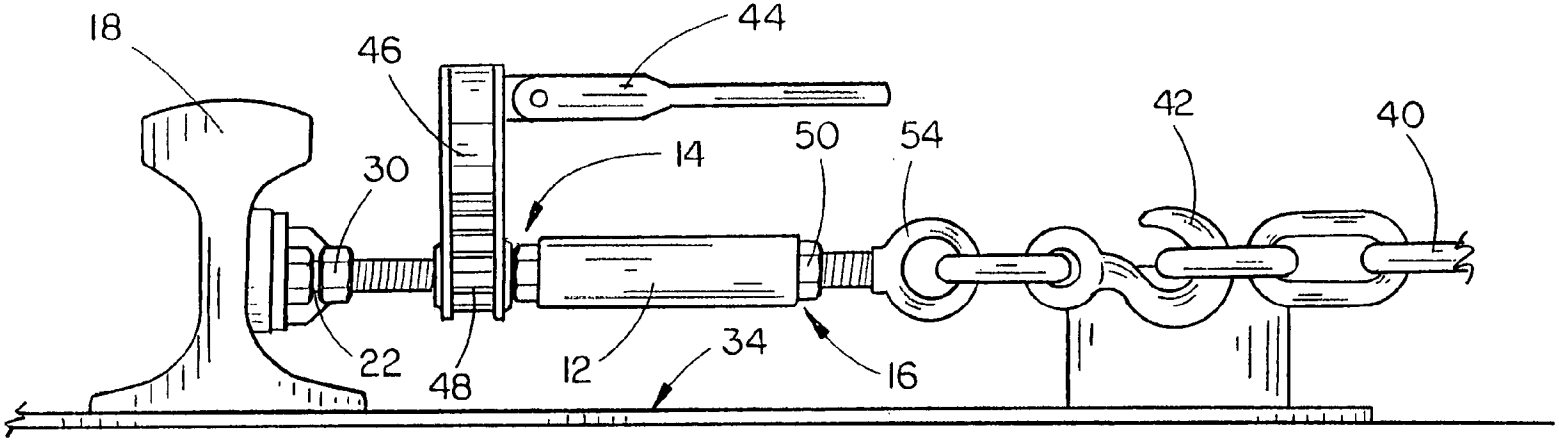
FIG. 6 is a side elevation view of still another embodiment of the railroad frog opening and closing device of the present invention as the same could be coupled with a railroad frog.

In another embodiment, the first attachment member could be shaped to have a nut 30, or other similar, hollow, threaded structure, that may be threadably joined with a bolt 22 that extends outwardly from the spring wing rail 18, such as that depicted in FIGS. 5 and 6. In another embodiment, the first attachment member may be provided in the form of a hook 32, or other similar, angular structure. The hook 32 is well suited for engagement within an aperture in a shock mount 20 or engagement around at least a portion of a structural feature of the spring wing rail 18.

It will be important that the second attachment member be shaped to releasably engage an anchoring member that is secured in a fixed position, spaced-apart from the spring wing rail 18. One example of such an anchoring member is the shock bracket 26 depicted in FIGS. 3, 4 and 5, which is typically secured to the frog base plate 34. Much like the shock mount 20, a typical shock bracket 26 will have an aperture formed therethrough. Accordingly, as with the first attachment member, a shackle 28 or other similarly configured structure is well suited for engagement with the aperture of the shock bracket 26.

Another structure that is well suited to serve as the anchoring member will be an opposing rail 36 or a rigid guard rail 38, positioned opposite the spring wing rail 18. Where these rail members are to be used as the anchoring member, a hook 32 or other angular structural member is well suited for engagement around a flange or other similar structural feature of the opposing rail 36 or the guard rail 38. A length of chain 40 may be used to couple an anchor engaging hook 32 with an attachment member hook 42, positioned adjacent the body member 12. The attachment member hook 32 can be provided in the form of other angular structures, D-rings, and other known linking devices. In another embodiment, it is contemplated that a length of the chain 40 or any structurally sound cord-like member could be used to extend from the attachment member hook 42, around one of the opposing rail 36 or guard rail 38, and then attached to itself using the hook 32 or linked directly to the attachment hook 42 without the use of hook 32.

A tensioning means is operatively coupled with the body member 12 in a manner that selectively moves the first and second attachment members toward one another when the tensioning means is actuated. In one preferred embodiment, the tensioning member is comprised of a lever arm 44, a pawl 46 and a ratchet assembly 48. As depicted in FIG. 4, the lever arm 44 may be coupled with the tensioning means in a manner that permits the lever arm to be pivoted into a storage position that is generally parallel to the body member 12 and pivoted upwardly into a position for use that will be generally perpendicular to the body member 12. Irrespective of its positioning, lever arm 44 is coupled with the pawl 46, which is selectively engageable with the ratchet assembly 48. The ratchet assembly 48 should be secured with the body member 12, or an associated structure, in a manner that causes the body member 12 to rotate when the lever arm 44 is actuated. In one preferred embodiment, at least one of the first or second end portions of the body member 12 is shaped to threadably receive a portion of the first or second attachment member. One example of this is depicted in FIG. 4, where a nut 50 is secured to the second end portion 16 of the body member 12. It can now be seen that rotation of the body member 12 and its associated nut 50 will advance the body member 12 upwardly along the threaded shaft extending outwardly from one end of the shackle 28. This motion will draw the first and second attachment members toward one another, moving the spring wing rail 18 into an open position, as depicted in FIG. 4. Where only one attachment member is threadably secured with the body member 12, it is contemplated that the opposite attachment member will be coupled with the body member 12 using a swivel or other such structure that permits free rotation of the attachment member with the body member 12. However, in a preferred embodiment, the opposing attachment member is also threadably secured with the body member 12, so that rotation of the body member 12 draws the first and second attachment members inwardly toward one another in a simultaneous fashion.

It is contemplated that other tensioning means could be employed with the present invention. For example, the body member 12 could be provided in the form of an elongated, flexible member, such as a chain or cord. In that situation, the tensioning means could be provided in the form of a simple winch assembly that is manually cranked to draw one end of the chain or cord member, attached to an attachment member, inwardly toward the opposite end of the body member 12 and its associated attachment member. Likewise, the tensioning means and the body member 12 could be provided in virtually any shape and constructed from a wide range of flexible, semi-rigid and rigid materials. Electric and manual versions of each different embodiment of tensioning means are contemplated.

Figure 3:
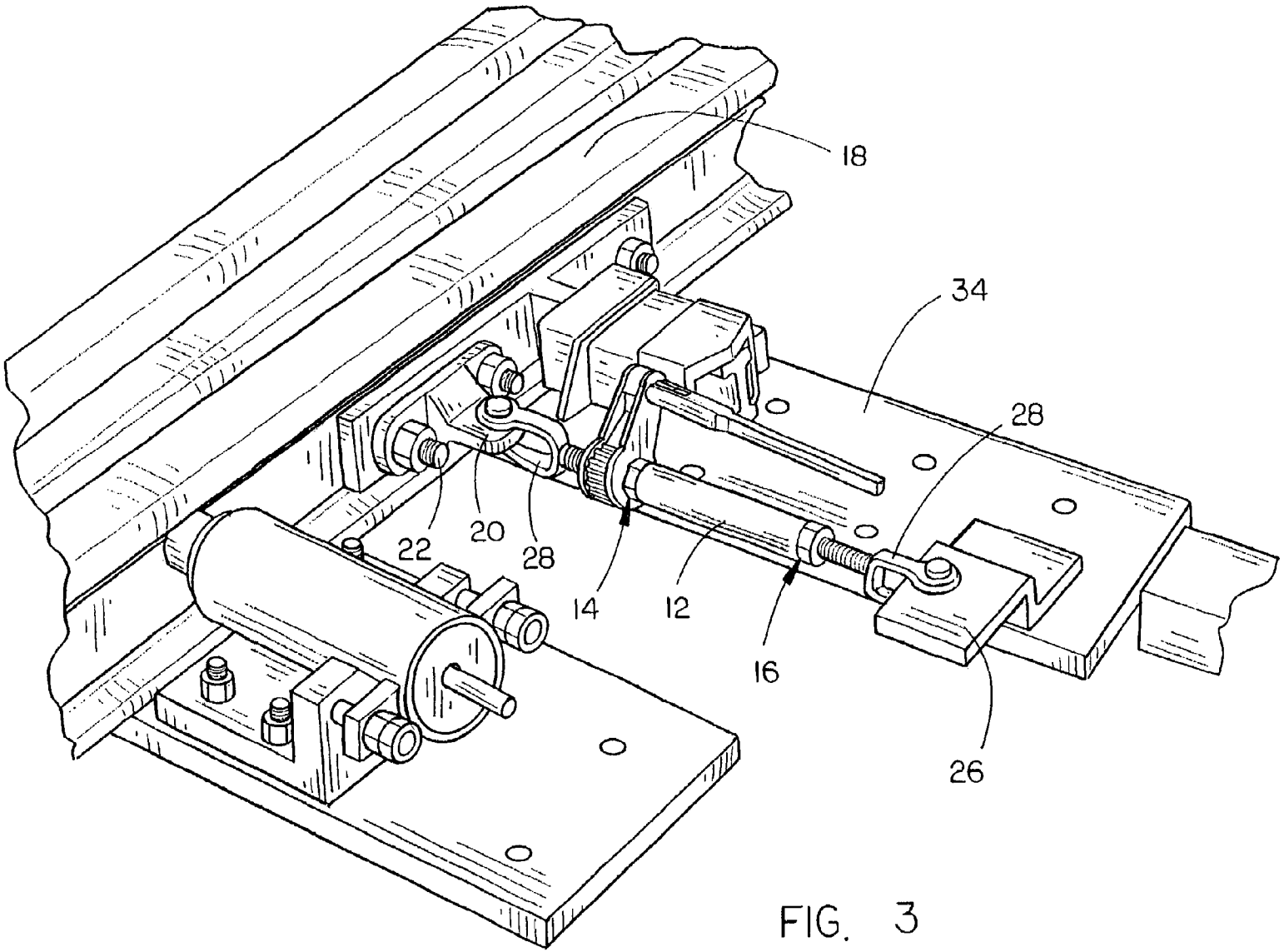
FIG. 3 is an isometric view of one preferred embodiment of the railroad frog opening and securing device of the present invention as the same could be coupled with a railroad frog.

The system 10 is preferably provided in a compact, lightweight and modular fashion that permits a single user to transport and use the same. In use, the system 10 will be adapted for the specific structural configuration of the railroad frog to be opened. For example, FIG. 3 depicts a railroad frog that is missing a shock 24 that extends between a shock mount 20 and a shock bracket 26. An individual may simply secure an appropriate first attachment member, such as a shackle 28, to the first end portion 14 of the body member 12. An appropriate second attachment member, such as a shackle 28, is coupled with the second end portion 16 of the body member 12. The positions of the first and second attachment members with respect to the body member 12 are adjusted until the first and second attachment members are easily coupled with the shock mount 20 and shock bracket 26. Once the system 10 is secured in position, the tensioning means is simply actuated to advance the first and second attachment members toward one another, drawing the spring wing rail 18 into an open position. It will now be apparent that the use of a pawl 46 and ratchet assembly 48 provide a safe and incremental manner of opening the spring wing rail 18 that also resists its unintentional closure when the lever arm 44 is released. Accordingly, once the spring wing rail 18 is sufficiently spaced apart from the v-point 52, the system 10 may simply be left in place to secure the spring wing rail 18 in its open position. Crews may then safely service or clean the frog without removing the system 10. It should be clear that, when the frog has been serviced, releasing the pawl 46 will permit the first and second attachment members to advance away from one another and permit the spring wing rail 18 to move into a closed position.

There may be instances where the individual finds that the shock 24 is retained in its shock mount 20 and shock bracket 26 or that one of the shock mount 20 of shock bracket 26 is damaged or missing. In these instances, the different embodiments of attachment members may be used to accommodate available anchoring members and structural features along the spring wing rail 18. FIG. 5, for example, depicts one attachment member that uses a nut 30, disposed at one end of a threaded bolt member, to engage the threaded end of a bolt 22, which protruded outwardly from the spring wing rail 18. FIG. 6 depicts an example where the second attachment member is provided in the form of an attachment member hook 42, which may be coupled to the second end portion 16 of the body member 12 using a threaded eye bolt 54. The attachment member hook 42 is secured to a length of chain 40 and possibly a hook 32, which is operatively coupled to an opposing rail member in a manner similar to that described previously herein. Each of the attachment members are interchangeable with one another and may be provided in countless different pairings in order to accommodate the structural nature of the railroad frog presented.

Figure 1:
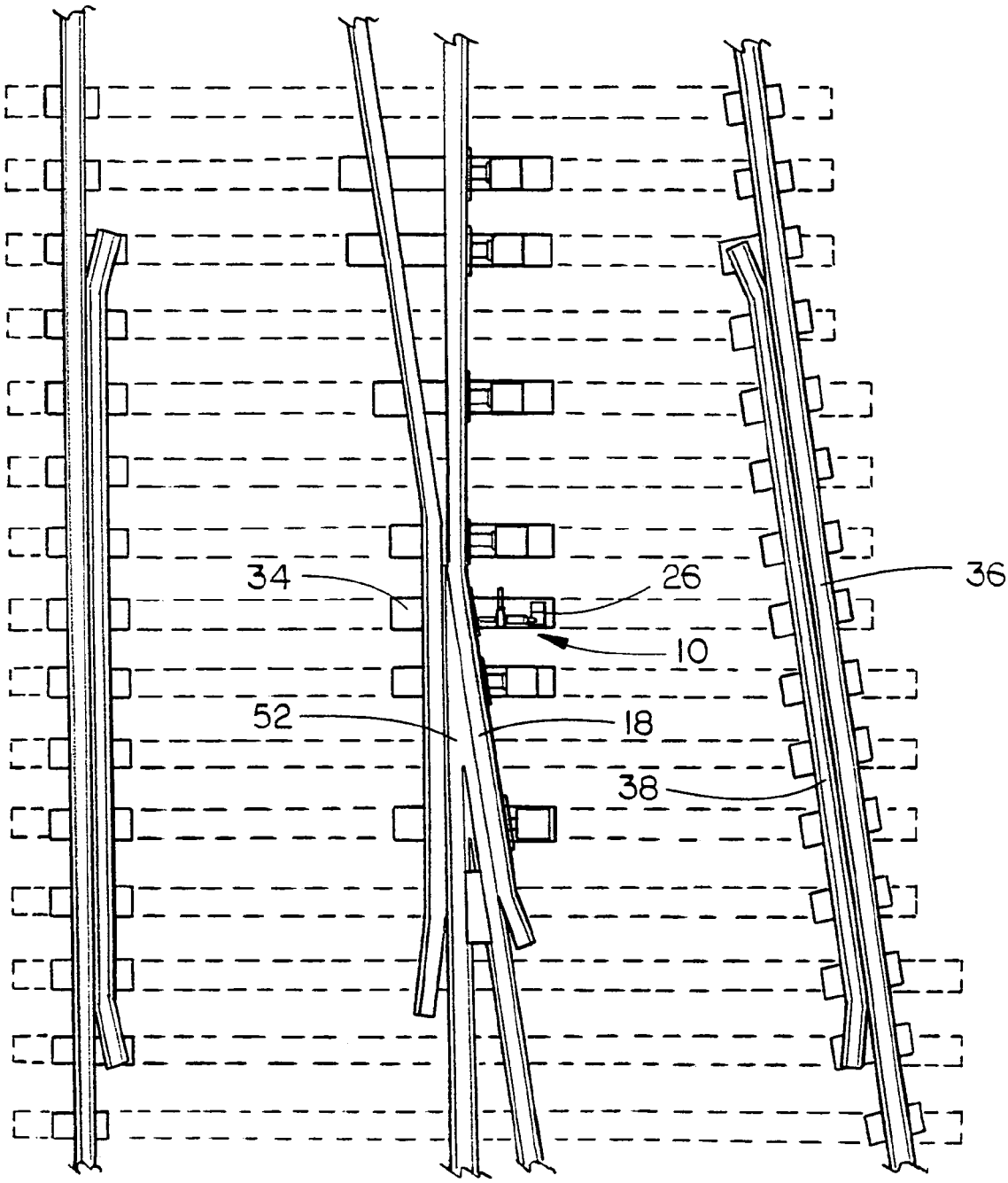
FIG. 1 is a plan view of an intersection of two running rails, comprising a commonly structured railroad frog.
Figure 2:
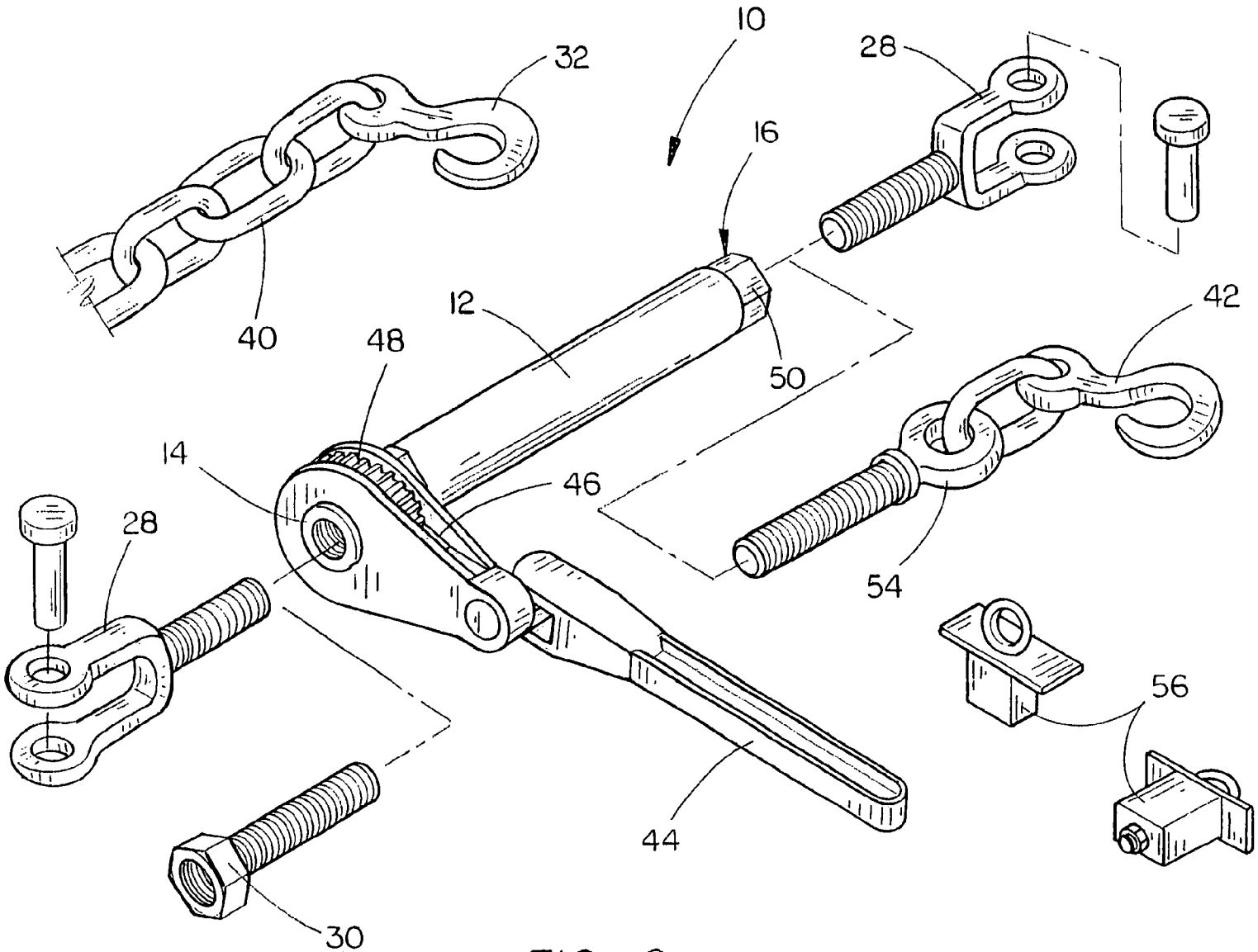
FIG. 2 is a partially exploded, isometric view of the railroad frog opening and securing device of the present invention and some of the preferred structural embodiments thereof.

As an added measure of security when securing the spring wing rail 18 in an open position, one or more blocks or wedges 56, such as those depicted in FIG. 2, may be releasably disposed between the spring wing rail 18 and the v-point 22. A rigid and durable material, such as steel and the like, should be used to fabricate the wedges 56. However, it will be preferred that a friction enhancing material be disposed on the exterior surfaces of the wedges 56 that are positioned adjacent the rail members. The material selected may be of an advanced compound, such as those used for many spray-in truck bed liners, or may simply be a natural or synthetic rubber compound, adhesive, or the like. Regardless of the selected material, it should have characteristics that inhibit slipping between the wedges 56 and the rails.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

We claim:

1. A device for opening a railroad frog, having at least a fixed v-point, a laterally movable spring wing rail having an upper end and a fixed wing rail having an upper end, the device comprising:

a body member, having first and second end portions;

a first attachment member that is operatively coupled with the first end portion of said body member and shaped and sized to releasably engage a portion of the spring wing rail below the upper end thereof;

a second attachment member that is operatively coupled with the second end portion of said body member and shaped and sized to releasably engage an anchoring member that is positioned in a fixed position, spaced-apart from the spring wing rail;

said first and second attachment members and said body member dwelling in planes below the upper ends of the spring wing rail and the fixed wing rail; and tensioning means, operatively coupled with said body member, for selectively moving said first and second attachment members toward one another.

2. The device of claim 1 wherein said first attachment member is threadably coupled with said body member and said tensioning means is coupled with said body member in a manner that causes said body member to rotate with respect to said first attachment member and incrementally advance said first attachment member toward said second attachment member when said tensioning means is actuated.

3. The device of claim 2 wherein a first end portion of said first attachment member is shaped to threadably receive a portion of a bolt that is secured to, and extends outwardly from, the spring wing rail.

4. The device of claim 3 wherein said anchoring member is a rail positioned oppositely from the spring wing rail and said second attachment member is shaped to extend around a portion of said rail in a manner that secures said second attachment member with said rail.

5. The device of claim 4 wherein a portion of said second attachment member is angular or hook-shaped.

6. The device of claim 2 wherein a first end portion of said first attachment member is shaped to releasably engage a shock mount that is coupled with said spring wing rail.

7. The device of claim 6 wherein said first attachment member is a shackle and said shock mount is provided with an aperture that is sized to receive a portion of said shackle.

8. The device of claim 6 wherein said anchoring member is a shock bracket that is positioned oppositely from the spring wing rail and a first end portion of said second attachment member is shaped to releasably engage said shock bracket.

9. The device of claim 8 wherein said second attachment member is a shackle and said shock bracket is provided with an aperture that is sized to receive a portion of said shackle.

10. The device of claim 8 wherein a portion of said second attachment member is angular or hook-shaped.

11. The device of claim 1 wherein said tensioning means is comprised of a lever arm, operatively coupled with a pawl that is selectively engageable with a ratchet assembly, which is operatively coupled with said body member in a manner that causes said body member to rotate when said lever arm is actuated.

12. The device of claim 11 wherein at least one of said first attachment member or said second attachment member are threadably coupled with said body member in a manner that incrementally advances said first and second attachment members toward one another when said body member rotates.

13. The device of claim 11 wherein said first attachment member and said second attachment member are threadably coupled with said body member in a manner that incrementally advances said first and second attachment members toward one another when said body member rotates.

14. The device of claim 12 wherein a first end portion of said first attachment member is shaped to threadably receive a portion of a bolt that is secured to, and extends outwardly from, the spring wing rail.

15. The device of claim 14 wherein said anchoring member is a rail positioned oppositely from the spring wing rail and said second attachment member is shaped to extend around a portion of said rail in a manner that secures said second attachment member with said rail.

16. The device of claim 12 wherein a first end portion of said first attachment member is shaped to releasably engage a shock mount that is coupled with the spring wing rail.

17. The device of claim 16 wherein said first attachment member is a shackle and said shock mount is provided with an aperture that is sized to receive a portion of said shackle.

18. The device of claim 16 wherein said anchoring member is a shock bracket that is positioned oppositely from the spring wing rail and a first end portion of said second attachment member is shaped to releasably engage said shock bracket.

* * * * *